US005759346A

United States Patent [19]

Vinson

[11] Patent Number: 5,759,346

[45] Date of Patent: Jun. 2, 1998

[54] PROCESS FOR MAKING SMOOTH UNCREPED TISSUE PAPER CONTAINING FINE PARTICULATE FILLERS

[75] Inventor: Kenneth Douglas Vinson, Cincinnati, Ohio

[73] Assignee: The Procter & Gamble Company, Cincinnati, Ohio

[21] Appl. No.: 720,110

[22] Filed: Sep. 27, 1996

[51] Int. Cl.[6] ..... D21H 21/10

[52] U.S. Cl. ..... 162/123; 162/109; 162/125; 162/127; 162/128; 162/129; 162/130; 162/158; 162/164.1; 162/168.1; 162/168.3; 162/175; 162/181.1; 162/181.2; 162/181.3; 162/181.5; 162/181.6; 162/181.8; 162/181.9

[58] Field of Search ..... 162/111, 109, 162/112, 113, 116, 117, 183, 181.1, 181.2, 181.6, 125, 128, 127, 175, 168.1, 123, 168.3, 129, 164.1, 130, 168.2, 181.5, 181.8, 181.9, 181.3

[56] References Cited

U.S. PATENT DOCUMENTS

| | | | |
|---|---|---|---|
| 2,216,143 | 10/1940 | Thiele et al. | 92/40 |
| 2,249,118 | 7/1941 | De Witt | 162/181.6 |
| 2,682,460 | 6/1954 | Carper | 162/181.6 |
| 2,955,067 | 10/1960 | McBurney et al. | 162/164.2 |
| 3,293,114 | 12/1966 | Kenaga et al. | 162/168 |
| 3,301,746 | 1/1967 | Sanford et al. | 162/113 |
| 3,821,068 | 6/1974 | Shaw | 162/111 |
| 3,823,062 | 7/1974 | Ward et al. | 162/123 |
| 3,974,025 | 8/1976 | Ayers | 162/113 |
| 3,994,771 | 11/1976 | Morgan, Jr. et al. | 162/113 |
| 4,094,736 | 6/1978 | Malden | 162/175 |
| 4,166,001 | 8/1979 | Dunning et al. | 162/111 |
| 4,174,998 | 11/1979 | Shiel | 162/175 |
| 4,181,567 | 1/1980 | Riddell et al. | 162/183 |
| 4,191,609 | 3/1980 | Trokhan | 162/113 |
| 4,210,490 | 7/1980 | Taylor | 162/175 |
| 4,295,933 | 10/1981 | Smith | 162/183 |
| 4,300,981 | 11/1981 | Carstens | 162/109 |
| 4,308,092 | 12/1981 | Latimer et al. | 162/111 |
| 4,406,737 | 9/1983 | Latimer et al. | 162/111 |
| 4,529,480 | 7/1985 | Trokhan | 162/109 |
| 4,619,734 | 10/1986 | Anderson | 162/111 |
| 4,637,859 | 1/1987 | Trokhan | 162/109 |
| 4,753,710 | 6/1988 | Langley et al. | 162/164.3 |
| 4,772,332 | 9/1988 | Nemeh et al. | 106/487 |
| 4,795,530 | 1/1989 | Soerens et al. | 162/111 |
| 4,892,590 | 1/1990 | Gill et al. | 162/175 |
| 4,925,530 | 5/1990 | Sinclair et al. | 162/183 |
| 4,927,498 | 5/1990 | Rushmere | 162/168.3 |
| 4,940,513 | 7/1990 | Spendel | 162/112 |
| 4,943,349 | 7/1990 | Gomez | 162/158 |
| 4,954,220 | 9/1990 | Rushmere | 162/168.3 |
| 4,959,125 | 9/1990 | Spendel | 162/158 |
| 4,978,396 | 12/1990 | Story | 106/436 |
| 5,017,268 | 5/1991 | Clitherow et al. | 162/146 |
| 5,068,276 | 11/1991 | Suitch et al. | 524/413 |
| 5,127,994 | 7/1992 | Johansson | 162/168.3 |
| 5,164,045 | 11/1992 | Awofeso et al. | 162/101 |
| 5,164,046 | 11/1992 | Ampulski et al. | 162/111 |
| 5,185,206 | 2/1993 | Rushmere | 428/403 |
| 5,227,023 | 7/1993 | Pounder et al. | 162/101 |
| 5,228,954 | 7/1993 | Vinson et al. | 162/100 |
| 5,266,622 | 11/1993 | Mazanek et al. | 524/131 |
| 5,399,412 | 3/1995 | Sudall et al. | 162/109 |
| 5,405,499 | 4/1995 | Vinson | 162/100 |
| 5,415,740 | 5/1995 | Schuster et al. | 162/168.3 |
| 5,487,813 | 1/1996 | Vinson et al. | 162/111 |

FOREIGN PATENT DOCUMENTS

| | | | |
|---|---|---|---|
| 0617164A1 | 9/1994 | European Pat. Off. | D21F 11/14 |
| 0677612A2 | 10/1995 | European Pat. Off. | D21F 11/14 |
| WO 8605530 | 9/1986 | France . | |
| 62-184197 | 8/1987 | Japan . | |

*Primary Examiner*—Peter Chin

*Attorney, Agent, or Firm*—Bart S. Hersko; Edward J. Milbrada; E. Kelly Linman

[57] ABSTRACT

A method for producing uncreped, strong, soft, and low dusting tissue paper webs useful in the manufacture of soft, absorbent sanitary products such as bath tissue, facial tissue, and absorbent towels is disclosed. The tissue papers comprise fibers such as wood pulp and a non-cellulosic, water insoluble particulate filler such as kaolin clay.

23 Claims, 3 Drawing Sheets

PROCESS FOR MAKING SMOOTH UNCREPED TISSUE PAPER CONTAINING FINE PARTICULATE FILLERS

TECHNICAL FIELD

This invention relates, in general, to tissue paper products made without dry creping. More specifically, it relates to processes for making tissue paper products from cellulose pulps and non-cellulosic water insoluble particulate fillers, without dry creping.

BACKGROUND OF THE INVENTION

Sanitary paper tissue products are widely used. Such items are commercially offered in formats tailored for a variety of uses such as facial tissues, toilet tissues and absorbent towels. The formats, i.e. basis weight, thickness, strength, sheet size, dispensing medium, etc. of these products often differ widely. Predominantly, they share in common the process by which they originate, the so-called creped papermaking process. However, it is possible to alternatively produce such products without creping by methods disclosed in this specification.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large diameter, generally 8–20 foot drum which is designed to be pressurized with steam to provide a hot surface for completing the drying of papermaking webs at the end of the papermaking process. The paper web which is first formed on a foraminous forming carrier, such as a Fourdrinier wire, where it is freed of the copious water needed to disperse the fibrous slurry is generally transferred to a felt or fabric in a so-called press section where de-watering is continued either by mechanically compacting the paper or by some other de-watering method such as through-drying with hot air, before finally being transferred in the semi-dry condition to the surface of the Yankee for the drying to be completed.

To produce comparable tissue paper webs without creping, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

Techniques to produce uncreped tissue in this manner are taught in the prior art. For example, Wendt, et. al. in European Patent Application 0 677 612 A2, published Oct. 18, 1995 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped throughdried sheets.

Softness is the tactile sensation perceived by the consumer as he/she holds a particular product, rubs it across his/her skin, or crumples it within his/her hand. This tactile sensation is provided by a combination of several physical properties. One of the most important physical properties related to softness is generally considered by those skilled in the art to be the stiffness of the paper web from which the product is made. Stiffness, in turn, is usually considered to be directly dependent on the strength of the web.

Strength is the ability of the product, and its constituent webs, to maintain physical integrity and to resist tearing, bursting, and shredding under use conditions.

Linting and dusting refers to the tendency of a web to release unbound or loosely bound fibers or particulate fillers during handling or use.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps.

As the world's supply of natural resources comes under increasing economic and environmental scrutiny, pressure is mounting to reduce consumption of forest products such as virgin chemical wood pulps in products such as sanitary tissues. One way to extend a given supply of wood pulp without sacrificing product mass is to replace virgin chemical pulp fibers with high yield fibers such as mechanical or chemi-mechanical pulps or to use fibers which have been recycled. Unfortunately, comparatively severe deterioration in performance usually accompanies such changes. Such fibers are prone to have a high coarseness and this contributes to the loss of the velvety feel which is imparted by prime fibers selected because of their flaccidness. In the case of the mechanical or chemi-mechanical liberated fiber, high coarseness is due to the retention of the non-cellulosic components of the original wood substance, such components including lignin and so-called hemicelluloses. This makes each fiber weigh more without increasing its length. Recycled paper can also tend to have a high mechanical pulp content, but, even when all due care is exercised in selecting the wastepaper grade to minimize this, a high coarseness still often occurs. This is thought to be due to the impure mixture of fiber morphologies which naturally occurs when paper from many sources is blended to make a recycled pulp. For example, a certain wastepaper might be selected because it is primarily North American hardwood in nature; however, one will often find extensive contamination from coarser softwood fibers, even of the most deleterious species such as variations of Southern U.S. pine. U.S. Pat. No. 4,300,981, Carstens, issued Nov. 17, 1981, and incorporated herein by reference, explains the textural and surface qualities which are imparted by prime fibers. U.S. Pat. No. 5,228,954, Vinson, issued Jul. 20, 1993, and U.S. Pat. No. 5,405,499, Vinson, issued Apr. 11, 1995, both incorporated herein by reference, disclose methods for upgrading such fiber sources so that they have less deleterious effects, but still the level of replacement is limited and the new fiber sources themselves are in limited supply and this often limits their use.

It has now been discovered that another method of limiting the use of wood pulp in sanitary tissue paper is to replace part of it with a lower cost, readily available filling material such as kaolin clay or calcium carbonate. While those skilled in the art will recognize that this practice has been common in some parts of the paper industry for many years, they will also appreciate that extending this approach to sanitary tissue products has involved particular difficulties which have prevented it from being practiced up to now.

One major restriction is the retention of the filling agent during the papermaking process. Among paper products, sanitary tissues are at an extreme of low basis weight. The basis weight of a tissue web as it is wound on a reel from a tissue making machine can be as low as about 10 g/m$^2$ and because of the foreshortening intrinsic to the process, the dry fiber basis weight in the forming section of the machine can be lower by from about 10% to as much as 80%. To compound the difficulties in retention caused by the low basis weight, tissue webs occupy an extreme of low density, often having an apparent density as wound on the reel of only about 0.1 g/cm$^3$ or less. While it is recognized that some of this loft is introduced during the foreshortening, those skilled in the art will recognize that tissue webs are generally formed from relatively free stock which means that the fibers of which they are comprised are not rendered flaccid from beating. Tissue machines are required to operate at very high speeds to be practical; thus free stock is needed to prevent excessive forming pressures and drying load. The relatively stiff fibers comprising the free stock retain their ability to prop open the embryonic web as it is forming. Those skilled in the art will at once recognize that such light weight, low density structures do not afford any significant opportunity to filter fine particulates as the web is forming. Filler particles not substantively affixed to fiber surfaces will be torn away by the torrent of the high speed approach flow systems, hurled into the liquid phase, and driven through the embryonic web into the water drained from the forming web. Only with repeated recycling of the water used to form the web does the concentration of particulate build to a point where the filler begins to exit with the paper. Such concentrations of solids in water effluent are impractical.

A second major limitation is the general failure of particulate fillers to naturally bond to papermaking fibers in the fashion that papermaking fibers tend to bond to each other as the formed web is dried. This reduces the strength of the product. Filler inclusion causes a reduction in strength, which if left uncorrected, severely limits products which are already quite weak. Steps required to restore strength such as increased fiber beating or the use of chemical strengthening agents is often restricted as well.

The deleterious effects of filler on sheet integrity also often cause hygiene problems by plugging machine clothing or by transferring poorly between machine sections.

Finally, tissue products containing fillers are prone to lint or dust. This is not only because the fillers themselves can be poorly trapped within the web, but also because they have the aforementioned bond inhibiting effect which causes a localized weakening of fiber anchoring into the structure. This tendency can cause operational difficulties in the papermaking processes and in subsequent converting operations, because of excessive dust created when the paper is handled. Another consideration is that the users of the sanitary tissue products made from the filled tissue demand that they be relatively free of lint and dust.

Consequently, the use of fillers in sanitary tissue papers has been severely limited. U.S. Pat. No. 2,216,143, issued to Thiele on Oct. 1, 1940, and incorporated herein by reference discusses the limitations of fillers on Yankee machines and discloses a method of incorporation which overcomes those limitations. Unfortunately, the method requires a cumbersome unit operation to coat a layer of adhesively bound particles onto the felt side of the sheet while it is in contact with the Yankee dryer. This operation is not practical for modern high speed machines, fails to recognize the means of producing sanitary tissue products without a Yankee dryer, and finally, those skilled in the art will recognize that the Thiele method would produce a coated rather than filled tissue product. A "filled tissue paper" is distinguished from "coated tissue paper" essentially by the methods practiced to produce them, i.e. a "filled tissue paper" is one which has the particulate matter added to the fibers prior to their assembly into a web while a "coated tissue paper" is one which has the particulate matter added after the web has been essentially assembled. As a result of this difference, a filled tissue paper product can be described as a relatively lightweight, low density tissue paper which contains a filler dispersed throughout the thickness of at least one layer of a multi-layer tissue paper, or throughout the entire thickness of a single-layered tissue paper. The term "dispersed throughout" means that essentially all portions of a particular layer of a filled tissue product contain filler particles, but, it specifically does not imply that such dispersion necessarily be uniform in that layer. In fact, certain advantages can be anticipated by achieving a difference in filler concentration as a function of thickness in a filled layer of tissue.

Therefore, it is the object of the present invention to provide for a tissue paper comprising a fine particulate filler which overcomes the aforementioned limitations of the prior art. The methods of the present invention produce, without creping, a soft tissue paper containing a retentive filler. The tissue paper possesses a high level of tensile strength and is low in dust.

This and other objects are obtained using the present invention as will be taught in the following disclosure.

SUMMARY OF THE INVENTION

The invention is a method for producing strong, soft filled uncreped tissue paper, low in lint and dust and comprising papermaking fibers and a non-cellulosic particulate filler, said filler comprising at least about 1% and up to about 50%, but, more preferably from about 8% to about 20% by weight of said tissue. Unexpected combinations of softness, strength, and resistance to dusting have been obtained by filling uncreped tissue paper with these levels of particulate fillers.

In its preferred embodiment, the filled tissue paper of the present invention has a basis weight between about 10 g/m$^2$ and about 50 g/m$^2$ and, more preferably, between about 10 g/m$^2$ and about 30 g/m$^2$. It has a density between about 0.03 g/cm$^3$ and about 0.6 g/cm$^3$ and, more preferably, between about 0.05 g/cm$^3$ and 0.2 g/cm$^3$.

The preferred embodiment further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The uncreped tissue paper of the present invention is non-compressively dried, most preferably by throughdrying. Resultant throughdried webs are pattern densified such that zones of relatively high density are dispersed within a high bulk field, including pattern densified tissue wherein zones of relatively high density are continuous and the high bulk field is discrete.

The invention provides for an uncreped tissue paper comprising papermaking fibers and a particulate filler. In its preferred embodiment, the particulate filler is selected from the group consisting of clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof. When selecting a filler from the above group several factors need to be evaluated. These include cost, availability, ease of retaining into the tissue paper, color, scattering potential, refractive index, and chemical compatibility with the selected papermaking environment.

A particularly suitable filler is kaolin clay. Most preferably the so called "hydrous aluminum silicate" form of kaolin clay is preferred as contrasted to the kaolins which are further processed by calcining.

The morphology of kaolin is naturally platy or blocky, but it is preferable to use clays which have not been subjected to mechanical delamination treatments as this tends to reduce the mean particle size. It is common to refer to the mean particle size in terms of equivalent spherical diameter. An average equivalent spherical diameter greater than about 0.2 micron, more preferably greater than about 0.5 micron is preferred in the practice of the present invention. Most preferably, an equivalent spherical diameter greater than about 1.0 micron is preferred.

All percentages, ratios and proportions herein are by weight unless otherwise specified.

DETAILED DESCRIPTION OF THE INVENTION

Figures 1A, 1B:
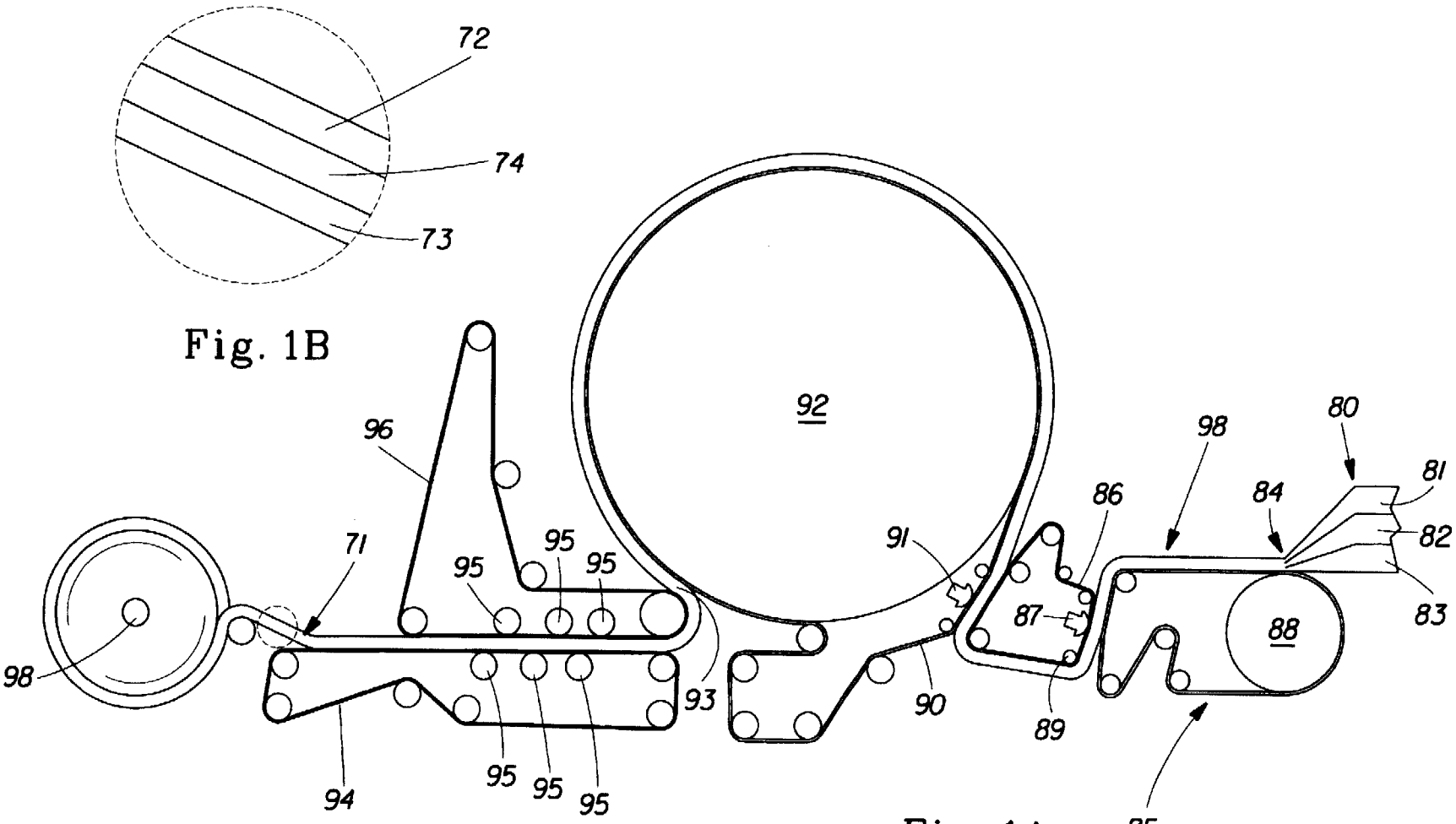
FIG. 1A is a schematic representation illustrating the papermaking process of the present invention for producing a strong, soft, and low lint uncreped tissue paper comprising papermaking fibers and particulate fillers.
FIG. 1B is an illustration revealing the layered structure of the tissue paper webs prepared by the papermaking process of the present invention.

While this specification concludes with claims particularly pointing out and distinctly claiming the subject matter regarded as the invention, it is believed that the invention can be better understood from a reading of the following detailed description.

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "water soluble" refers to materials that are soluble in water to at least 3%, by weight, at 25° C.

As used herein, the terms "tissue paper web, paper web, web, paper sheet and paper product" all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, forming an embryonic web, transferring the embryonic web from the forming surface to a transfer surface traveling at a lower speed than the forming surface. The web is then transferred to a fabric upon which it is throughdried to a final dryness after which it is wound upon a reel.

As used herein, the term "filled tissue paper" means a paper product that can be described as a relatively lightweight, low density uncreped tissue paper which contains a filler dispersed throughout the thickness of at least one layer of a multi-layer tissue paper, or throughout the entire thickness of a single-layered tissue paper. The term "dispersed throughout" means that essentially all portions of a particular layer of a filled tissue product contain filler particles, but, it specifically does not imply that such dispersion necessarily be uniform in that layer. In fact, certain advantages can be anticipated by achieving a difference in filler concentration as a function of thickness in a filled layer of tissue.

The terms "multi-layered tissue paper web, multi-layered paper web, multi-layered web, multi-layered paper sheet and multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

As used herein, the term "single-ply tissue product" means that it is comprised of one ply of uncreped tissue; the ply can be substantially homogeneous in nature or it can be a multi-layered tissue paper web. As used herein, the term "multi-ply tissue product" means that it is comprised of more than one ply of uncreped tissue. The plies of a multi-ply tissue product can be substantially homogeneous in nature or they can be multi-layered tissue paper webs.

Most generally, the present invention is a process for incorporating a non-cellulosic particulate filler into a tissue paper. The process comprises the steps of:

(a) providing an aqueous suspension of papermaking furnish comprising papermaking fibers and non-cellulosic particulate filler;

(b) depositing said aqueous suspension of papermaking furnish onto the surface of an endless traveling foraminous forming fabric to form a wet embryonic papermaking web;

(c) transferring said wet embryonic papermaking web from the forming fabric to a first transfer fabric traveling at a speed from about 5% to about 75% slower than the forming fabric; and (d) transferring the wet embryonic papermaking web from the first transfer fabric via at least one further transfer to a drying fabric, whereupon said wet embryonic papermaking web is non-compressively dried.

In one particularly preferred embodiment, the present invention is a process for incorporating a fine non-cellulosic particulate filler into a multi-layered tissue paper, said process comprising the steps of:

(a) providing an aqueous suspension of papermaking furnish comprising papermaking fibers and non-cellulosic particulate filler;

(b) providing at least one additional papermaking furnish;

(c) depositing said papermaking furnishes onto the surface of a traveling foraminous forming fabric to form a wet embryonic papermaking web from the filler-containing aqueous papermaking furnish and the additional papermaking furnish in a manner to create a multi-layered paper web wherein at least one layer is formed from the filler-containing aqueous papermaking furnish and at least one layer is formed from said additional papermaking furnish;

(d) transferring said wet embryonic papermaking web from the forming surface to a first transfer fabric traveling at a speed from about 5% to about 75% slower than the forming fabric; and (e) transferring the wet embryonic papermaking web from the first transfer fabric via at least one further transfer to a drying fabric, whereupon said wet embryonic papermaking web is non-compressively dried.

The preferred particulate filler comprises from about 1 % to about 50% of the total weight of the tissue paper and is selected from the group consisting of clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof.

The most preferred particulate filler to employ in the present invention is kaolin clay and its preferred particle size equates to an average equivalent spherical diameter between about 0.5μ and about 5μ.

The preferred non-compressive drying technique to be employed in the present invention is to dry the wet embryonic papermaking web by throughdrying.

Those skilled in the art will recognize that there are a number of methods which can be employed to provide the aqueous suspension of papermaking furnish comprising papermaking fibers and non-cellulosic particulate filler to be employed in the present invention. The present invention embodies two methods useful for providing this aqueous suspension. The first method comprises the steps of:

(a) contacting an aqueous dispersion of a non-cellulosic particulate filler with an aqueous dispersion of starch, (b) mixing the aqueous dispersion of starch-contacted filler with papermaking fibers forming a mixture of papermaking fibers and starch-contacted filler; and (c) contacting said mixture of papermaking fibers and starch-contacted filler with a flocculant, thereby forming said aqueous suspension of papermaking furnish.

The alternative embodiment comprises the steps of:

(a) contacting an aqueous dispersion of a non-cellulosic particulate filler with an aqueous dispersion of an anionic polyelectrolyte polymer, (b) mixing the aqueous dispersion of anionic polyelectrolyte polymer-contacted filler with papermaking fibers forming a mixture of papermaking fibers and polymer-contacted filler; and (c) contacting said mixture of papermaking fibers and polymer-contacted filler with a cationic retention aid, thereby forming said aqueous suspension of papermaking furnish.

The following is a more detailed discussion of the elements of each of these embodiments of the present invention. The different embodiments utilize some preferred raw materials in common. These are described as follows:

The Particulate Filler

In its preferred embodiment, the invention incorporates non-cellulosic particulate filler such that said filler comprises at least about 1% and up to about 50%, but, more preferably from about 8% to about 20% by weight of said tissue. Unexpected combinations of softness, strength, and resistance to dusting have been obtained by filling uncreped tissue paper with these levels of particulate fillers by the process of the present invention.

The invention provides for an uncreped tissue paper comprising papermaking fibers and a particulate filler. Preferably, the particulate filler is selected from the group consisting of clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof. When selecting a filler from the above group several factors need to be evaluated. These include cost, availability, ease of retaining into the tissue paper, color, scattering potential, refractive index, and chemical compatibility with the selected papermaking environment.

It has now been found that a particularly suitable particulate filler is kaolin clay. Kaolin clay is the common name for a class of naturally occurring aluminum silicate mineral beneficiated as a particulate.

With respect to terminology, it is noted that it is common in the industry, as well as in the prior art patent literature, when referring to kaolin products or processing, to use the term "hydrous" to refer to kaolin which has not been subject to calcination. Calcination subjects the clay to temperatures above 450° C., which temperatures serve to alter the basic crystal structure of kaolin. The so-called "hydrous" kaolins may have been produced from crude kaolins, which have been subjected to beneficiation, as, for example, to froth flotation, to magnetic separation, to mechanical delamination, grinding, or similar comminution, but not to the mentioned heating as would impair the crystal structure.

To be accurate in a technical sense, the description of these materials as "hydrous" is inappropriate. More specifically, there is no molecular water actually present in the kaolinite structure. Thus although the composition can be, and often is, arbitrarily written in the form $2H_2O.Al_2O_3.2SiO_2$, it has long been known that kaolinite is an aluminum hydroxide silicate of approximate composition $Al_2(OH)_4Si_2O_5$, which equates to the hydrated formula just cited. Once kaolin is subjected to calcination, which for the purposes of this specification refers to subjecting a kaolin to temperatures exceeding 450° C., for a period sufficient to eliminate the hydroxyl groups, the original crystalline structure of the kaolinite is destroyed. Therefore, although technically such calcined clays are no longer "kaolin", it is common in the industry to refer to these as calcined kaolin, and, for the purposes of this specification, the calcined materials are included when the class of materials "kaolin" is cited. Accordingly, the term "hydrous aluminum silicate" refers to natural kaolin, which has not been subjected to calcination.

Hydrous aluminum silicate is the kaolin form most preferred in the practice of the present invention. It is therefore characterized by the before mentioned approximate 13% by weight loss as water vapor at temperatures exceeding 450° C.

The morphology of kaolin is naturally platy or blocky, because it naturally occurs in the form of thin platelets which adhere together to form "stacks" or "books". The stacks separate to some degree into the individual platelets during processing, but it is preferable to use clays which have not been subjected to extensive mechanical delamination treatments as this tends to reduce the mean particle size. It is common to refer to the mean particle size in terms of equivalent spherical diameter. An average equivalent spherical diameter greater than about 0.2μ, more preferably greater than about 0.5μ is preferred in the practice of the present invention. Most preferably, an equivalent spherical diameter greater than about 1μ, but less than about 5μ.

Most mined clay is subjected to wet processing. Aqueous suspending of the crude clay allows the coarse impurities to be removed by centrifugation and provides a media for chemical bleaching. A polyacrylate polymer or phosphate salt is sometimes added to such slurries to reduce viscosity and slow settling. Resultant clays are normally shipped without drying at about 70% solids suspensions, or they can be spray dried.

Treatments to the clay, such as air floating, froth flotation, washing, bleaching, spray drying, the addition of agents as slurry stabilizers and viscosity modifiers, are generally acceptable and should be selected based upon the specific commercial considerations at hand in a particular circumstance.

Each clay platelet is itself a multi-layered structure of aluminum polysilicates. A continuous array of oxygen atoms forms one face of each basic layer. The polysilicate sheet structure edges are united by these oxygen atoms. A continuous array of hydroxyl groups of joined octahedral alumina structures forms the other face forming a two-dimensional polyaluminum oxide structure. The oxygen atoms sharing the tetrahedral and octahedral structures bind the aluminum atoms to the silicon atoms.

Imperfections in the assembly are primarily responsible for the natural clay particles possessing an anionic charge in suspension. This happens because other di-, tri-, and tetravalent cations substitute for aluminum. The consequence is that some of the oxygen atoms on the surface become anionic and become weakly dissociable hydroxyl groups.

Natural clay also has a cationic character capable of exchanging their anions for others that are preferred. This happens because aluminum atoms lacking a full complement of bonds occur at some frequency around the peripheral edge of the platelet. They must satisfy their remaining valencies by attracting anions from the aqueous suspension that they occupy. If these cationic sites are not satisfied with anions from solutions, the clay can satisfy its own charge balance by orienting itself assembling a assembling a "card house" structure which forms thick dispersions. Polyacrylate dispersants ion exchange with the cationic sites providing a repulsive character to the clay preventing these assemblies and simplifying the production, shipping, and use of the clay.

A kaolin grade WW Fil® is a kaolin marketed by Dry Branch Kaolin Company of Dry Branch, Ga. suitable to make tissue paper webs of the present invention. It is available in either spray dried or in slurry (70% solids) form.

Starch

The embodiments of the present invention preferably utilize starch in forming the aqueous suspension of papermaking furnish comprising papermaking fibers and non-cellulosic particulate filler. The most preferred form of starch for the present invention is a so called "cationic starch".

As used herein the term "cationic starch" is defined as starch, as naturally derived, which has been further chemically modified to impart a cationic constituent moiety. Preferably the starch is derived from corn or potatoes, but can be derived from other sources such as rice, wheat, or tapioca. Starch from waxy maize also known industrially as amioca starch is particularly preferred. Amioca starch differs from common dent corn starch in that it is entirely amylopectin, whereas common corn starch contains both amylopectin and amylose. Various unique characteristics of amioca starch are further described in "Amioca—The Starch from Waxy Corn", H. H. Schopmeyer, Food Industries, December 1945, pp. 106–108.

Cationic starches can be divided into the following general classifications: (1) tertiary aminoalkyl ethers, (2) onium starch ethers including quaternary amines, phosphonium, and sulfonium derivatives, (3) primary and secondary aminoalkyl starches, and (4) miscellaneous (e.g., imino starches). New cationic products continue to be developed, but the tertiary aminoalkyl ethers and quaternary ammonium alkyl ethers are the main commercial types. Preferably, the cationic starch has a degree of substitution ranging from about 0.01 to about 0.1 cationic substituent per anhydroglucose units of starch; the substituents preferably chosen from the above mentioned types. Suitable starches are produced by National Starch and Chemical Company, (Bridgewater, N.J.) under the tradename, RediBOND®. Grades with cationic moieties only such as RediBOND 5320® and RediBOND 5327® are suitable, and grades with additional anionic functionality such as RediBOND 2005® are also suitable.

Anionic Polyelectrolyte Polymer

Each embodiment of the present invention might advantageously employ an "anionic polyelectrolyte polymer", a term which, as used herein, refers to a high molecular weight polymer having pendant anionic groups.

Anionic polymers often have a carboxylic acid (—COOH) moiety. These can be immediately pendant to the polymer backbone or pendant through typically, an alkalene group, particularly an alkalene group of a few carbons. In aqueous medium, except at low pH, such carboxylic acid groups ionize to provide to the polymer a negative charge.

Anionic polymers suitable for anionic flocculants do not wholly or essentially consist of monomeric units prone to yield a carboxylic acid group upon polymerization, instead they are comprised of a combination of monomers yielding both nonionic and anionic functionality. Monomers yielding nonionic functionality, especially if possessing a polar character, often exhibit the same flocculating tendencies as ionic functionality. The incorporation of such monomers is often practiced for this reason. An often used nonionic unit is (meth) acrylamide.

Anionic polyacrylamides having relatively high molecular weights are satisfactory flocculating agents. Such anionic polyacrylamides contain a combination of (meth) acrylamide and (meth) acrylic acid, the latter of which can be derived from the incorporation of (meth)acrylic acid monomer during the polymerization step or by the hydrolysis of some (meth) acrylamide units after the polymerization, or combined methods.

The polymer is preferably substantially linear in comparison to the globular structure of anionic starch.

A wide range of charge densities is satisfactory for the present invention, although a medium density is preferred. Polymers useful to make products of the present invention contain cationic functional groups at a frequency ranging from as low as about 0.2 to as high as about 7 or higher, but more preferably in a range of about 2 to about 4 milliequivalents per gram of polymer.

Polymers useful for the process according to the present invention should have a molecular weight of at least about 500,000, and preferably a molecular weight above about 1,000,000, and may advantageously have a molecular weight above 5,000,000.

An example of an acceptable anionic polyelectrolyte polymer is RETEN 235®, which is delivered as a solid granule; a product of Hercules, Inc. of Wilmington, Del. Other acceptable anionic polyelectrolytes are Accurac 62® and Accurac 171RS®, products of Cytec, Inc. of Stamford, CT. All of these products are polyacrylamides, specifically, copolymers of acrylamide and acrylic acid.

Papermaking Fibers

It is anticipated that wood pulp in all its varieties will normally comprise the papermaking fibers used in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, ThermoMechanical Pulp (TMP) and Chemi-ThermoMechanical Pulp (CTMP). Pulps derived from both deciduous and coniferous trees can be used.

Both hardwood pulps and softwood pulps as well as combinations of the two may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises forming layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

Papermaking fibers are first prepared by liberating the individual fibers into a aqueous slurry by any of the common pulping methods adequately described in the prior art. Refining, if necessary, is then carried out on the selected parts of the papermaking furnish. It has been found that there are advantages in retention and in reducing lint, if the aqueous slurry of papermaking fibers which will later be used to adsorb the particulate filler is refined at least to the equivalent of a Canadian Standard Freeness of about 600 ml, but, more preferably about 550 ml or below.

In one preferred embodiment of the present invention, which utilizes multiple papermaking furnishes, the furnish containing the papermaking fibers which will be contacted by the particulate filler is predominantly of the hardwood type, preferably of content of at least about 80% hardwood.

PROCESS FOR INCLUDING A FINE PARTICULATE FILLER INTO TISSUE PAPER USING STARCH

The following discussion is specific to the first embodiment of the present invention for providing the aqueous suspension of papermaking furnish comprising papermaking fibers and non-cellulosic particulate filler. This embodiment comprises the steps of:

(a) contacting an aqueous dispersion of a non-cellulosic particulate filler with an aqueous dispersion of starch;

(b) mixing the aqueous dispersion of starch-contacted filler with papermaking fibers forming a mixture of papermaking fibers and starch-contacted filler; and (c) contacting said mixture of papermaking fibers and starch-contacted filler with a flocculant, thereby forming said aqueous suspension of papermaking furnish.

Contacting Particulate Filler with Starch

The selected particulate filler is first prepared by also dispersing it into an aqueous slurry. Dilution generally favors the absorption of polymers and retention aids onto solids surfaces; consequently, the slurry or slurries of particulate fillers at this point in the preparation is preferably no more than about 10% and more preferably from about 1–5% solids by weight.

Similarly, the starch is preferably properly dispersed in water prior to contacting the particulate filler. The raw starch used in this step can be of various types. Preferably, a starch which has limited water solubility in suspensions of the non-cellulosic particulate filler are preferred. Most preferable are cationic starches as described herein before.

The starch employed in this embodiment of the present invention can be in granular form, pre-gelatinized granular form, or dispersed form. While the dispersed form is preferred for ease of use, any form of raw starch can be used and none are disclaimed. If the raw starch is in granular pre-gelatinized form, it need only be dispersed in cold water prior to its use, with the only precaution being to use equipment which overcomes any tendency to gel-block in forming the dispersion. Suitable dispersers known as eductors are common in the industry. If the starch is in granular form and has not been pre-gelatinized, it is necessary to cook the starch to induce swelling of the granules. Preferably, such starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

After reaching a properly water dispersed starch, it need only be further diluted to the proper consistency for use. The preferred dilutions are below about 10% solids, but above about 0.1% solids. Most preferred dilutions are about 1% solids.

When both the particulate filler and the starch are brought to this condition, the two dispersions can be mixed. With cationic starch and anionic filler, the reaction between the starch and the particulate filler is relatively fast, and the minimum amount of time required to thoroughly mix the two is sufficient time for the reaction between the materials to occur as well.

The starch is preferably added in amounts of about 0.1% to about 5%, but most preferably from about 0.25% to about 0.75%, by weight based on the weight of the particulate filler.

While not wishing to be bound by theory, it is believed that the cationic starch which is initially dissolved in water, becomes insoluble in the presence of filler because of its attraction for the anionic sites on the filler surface. This causes the filler to be covered with the bushy starch molecules which provide an attractive surface for more filler particles, ultimately resulting in agglomeration of the filler. While the charge characteristics of the starch are important to aid in the formation of the agglomerates, the essential characteristic of the starch is believed to be related to the size and shape of the starch molecule rather than wholly its charge characteristics. For example, inferior results would be expected by substituting a charge biasing species such as synthetic linear polyelectrolyte for the cationic starch.

Mixing the Starch and Filler with Papermaking Fibers

Dilution generally favors the absorption of polymers and retention aids; consequently, the slurry or slurries of papermaking fibers at this point in the preparation is preferably no more than from about 3–5% solids by weight.

In preparation to be used in the present invention, it is only necessary to prepare the papermaking fibers by forming an aqueous slurry with them in a conventional repulper. In this form, it is most convenient to slurry the fibers at less than about 15%, and more preferably from about 3% to about 5% in water.

After forming an aqueous slurry of the papermaking fibers, they can be mixed by any conventional batch or continuous process with the combined starch and particulate filler composition previously formed.

The resultant aqueous papermaking furnish is now prepared for contacting with the cationic flocculant.

Contacting the Aqueous Papermaking Furnish with the Flocculant

Flocculant

Flocculant is a term, as used herein, used to refer to additives used to increase the retention of the fine furnish solids in the web during the papermaking process. Without adequate retention of the fine solids, they are either lost to the process effluent or accumulate to excessively high concentrations in the recirculating white water loop and cause production difficulties including deposit build-up and impaired drainage. Chapter 17 entitled "Retention Chemistry" of "Pulp and Paper, Chemistry and Chemical Technology", 3rd ed. Vol. 3, by J. E. Unbehend and K. W. Britt, A Wiley Interscience Publication, incorporated herein by reference, provides the essential understanding of the types and mechanisms by which polymeric retention aids function. A flocculant agglomerates suspended particles generally by a bridging mechanism. While certain multivalent cations are considered common flocculants, they are generally being replaced in practice by superior acting polymers which carry many charge along the polymer chain.

This embodiment of the present invention uses as a flocculant a chemical species having a plurality of charges of either the anionic or cationic type or a combination of the two, so that it is capable of bridging together charged particles in aqueous suspensions. It is well known in the papermaking field that shear stages break down the flocs formed by flocculating agents, and hence it is preferred practice to add the flocculating agent after as many shear stages encountered by the aqueous papermaking slurry as feasible.

One type of flocculant acceptable for use in the present invention is an "anionic polyelectrolyte polymer", a material which has been described herein before. An even more preferred type of flocculant for use in the present invention is a "cationic polyelectrolyte polymer", a term which, as used herein, refers to a high molecular weight polymer having pendant cationic groups.

A "cationic flocculant", a term as used herein, refers to a class of polyelectrolyte which generally originate from copolymerization of one or more ethylenically unsaturated monomers, generally acrylic monomers, that consist of or include cationic monomer.

Suitable cationic monomers are dialkyl amino alkyl-(meth) acrylates or -(meth) acrylamides, either as acid salts or quaternary ammonium salts. Suitable alkyl groups include dialkylaminoethyl (meth) acrylates, dialkylaminoethyl (meth) acrylamides and dialkylaminomethyl (meth) acrylamides and dialkylamino-1,3-propyl (meth) acrylamides. These cationic monomers are preferably copolymerized with a nonionic monomer, preferably acrylamide. Other suitable polymers are polyethylene imines, polyamide epichlorohydrin polymers, and homopolymers or copolymers, generally with acrylamide, of monomers such as diallyl dimethyl ammonium chloride.

The flocculant is preferably a substantially linear polymer in comparison, for example, to the globular structure of cationized starches.

A wide range of charge densities is useful, although a medium density is preferred. Polymers useful to make products of the present invention contain cationic functional groups at a frequency ranging from as low as about 0.2 to as high as 2.5, but more preferably in a range of about 1 to about 1.5 milliequivalents per gram of polymer.

Polymers useful to make tissue products according to the present invention should have a molecular weight of at least about 500,000, and preferably a molecular weight above about 1,000,000, and, may advantageously have a molecular weight above 5,000,000.

Examples of acceptable materials are RETEN 1232® and Microform 2321®, both emulsion polymerized cationic polyacrylamides and RETEN 157®, which is delivered as a solid granule; all are products of Hercules, Inc. of Wilmington, Del. Another acceptable cationic flocculant is Accurac 91, a product of Cytec, Inc. of Stamford, Conn.

Contacting the Aqueous Furnish and the Flocculant

The flocculant is added to the aqueous papermaking furnish which is comprised of a mixture of papermaking fibers and a starch-treated particulate filler composition. It can be added at any suitable point in the approach flow of the stock preparation system of the papermaking process. It is particularly preferred to add the cationic flocculant after the fan pump in which the final dilution with the recycled machine water returned from the process is made. It is well known in the papermaking field that shear stages break down bridges formed by flocculating agents, and hence it is preferred practice to add the flocculating agent after as many shear stages encountered by the aqueous papermaking slurry as feasible.

The dilution which takes place at the fan pump preferably reduces the consistency to a point below about 0.5% solids, and most preferably between about 0.05%–0.2%.

The flocculant is delivered as an aqueous dispersion. Because of the relatively high molecular weight of the flocculant, the solids content of the aqueous dispersion needs to be low. Preferably, the solids content of the aqueous dispersion of the cationic flocculant is less than about 0.3% solids.

Whether the polymer chosen for this application is of the anionic or cationic type, they will be delivered as aqueous solutions at comparable concentrations and overall usage rates. It is preferred that the concentration of these polymers be below about 0.3% solids and more preferably below about 0.1% prior to contacting them with aqueous papermaking furnishes. Those skilled in the art will recognize that the desired usage rates of these polymers will vary widely. Amounts as low as about 0.005% polymer by weight based on the dry weight of the polymer and the dry finished weight of tissue paper will deliver useful results, but normally the usage rate would be expected to be higher; even higher for the purposes of the present invention than commonly practiced as application of these materials. Amounts as high as about 0.5% might be employed, but normally about 0.1% is optimum.

In the present invention, it is possible to utilize multiple aqueous papermaking slurries, one or more of the slurries can be used to adsorb particulate fibers in accordance with the present invention. Even if one or more aqueous slurries of papermaking fibers in the papermaking process is maintained relatively free of particulate fillers prior to reaching its fan pump, it is preferred to add a flocculant after the fan pump of such slurries. This is because the recycled water used in that fan pump contains filler agglomerates which failed to retain in previous passes over the foraminous screen. When multiple dilute fiber slurries are used in the creped papermaking process, the flow of cationic or anionic flocculant is preferably added to all dilute fiber slurries and it should be added in a manner which approximately proportions it to the flow of solids in the aqueous papermaking furnish of each dilute fiber slurry.

Figure 2:
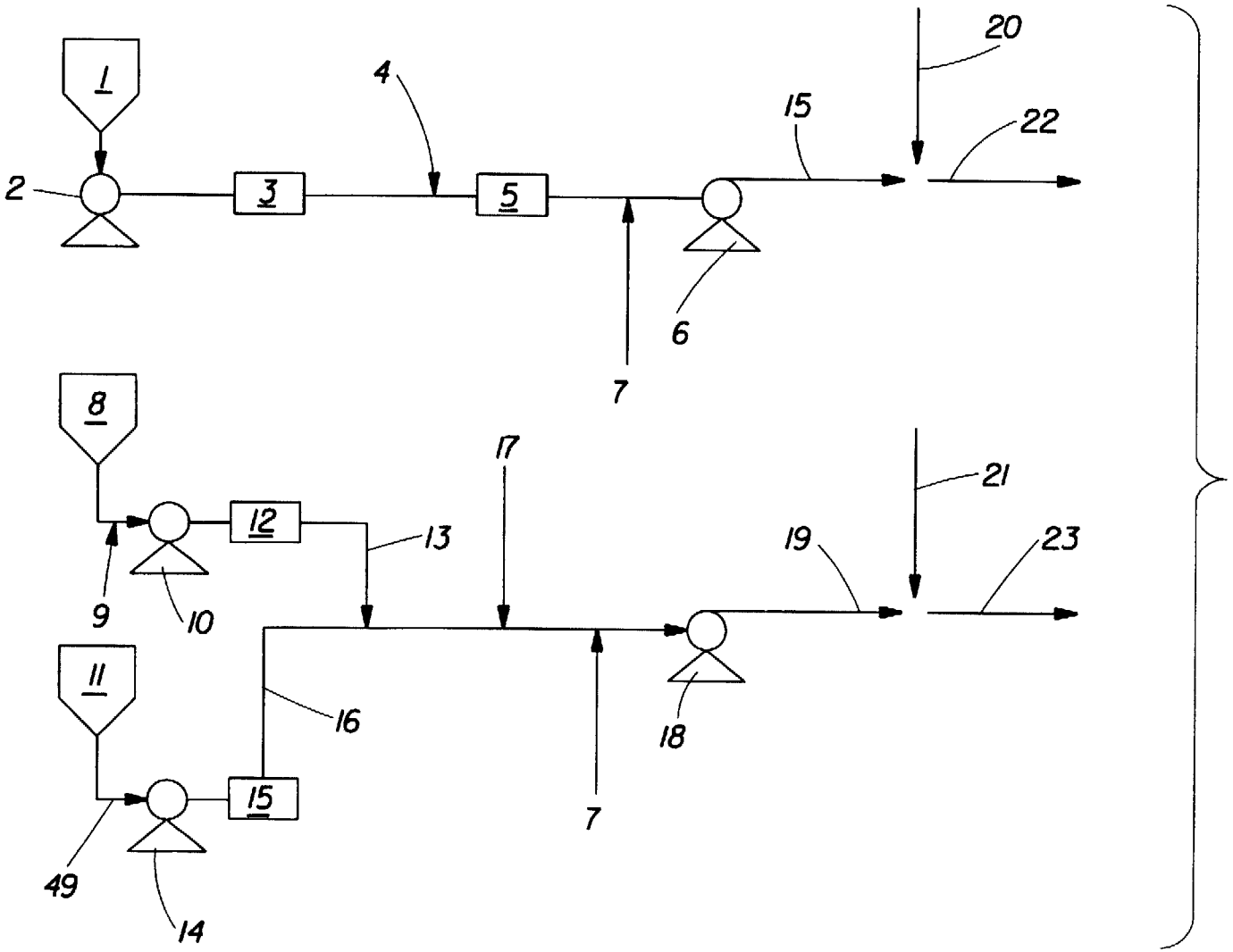
FIG. 2 is a schematic representation illustrating the steps for preparing the aqueous papermaking furnish for the papermaking process, according to one embodiment of the present invention based on starch.
Figure 3:
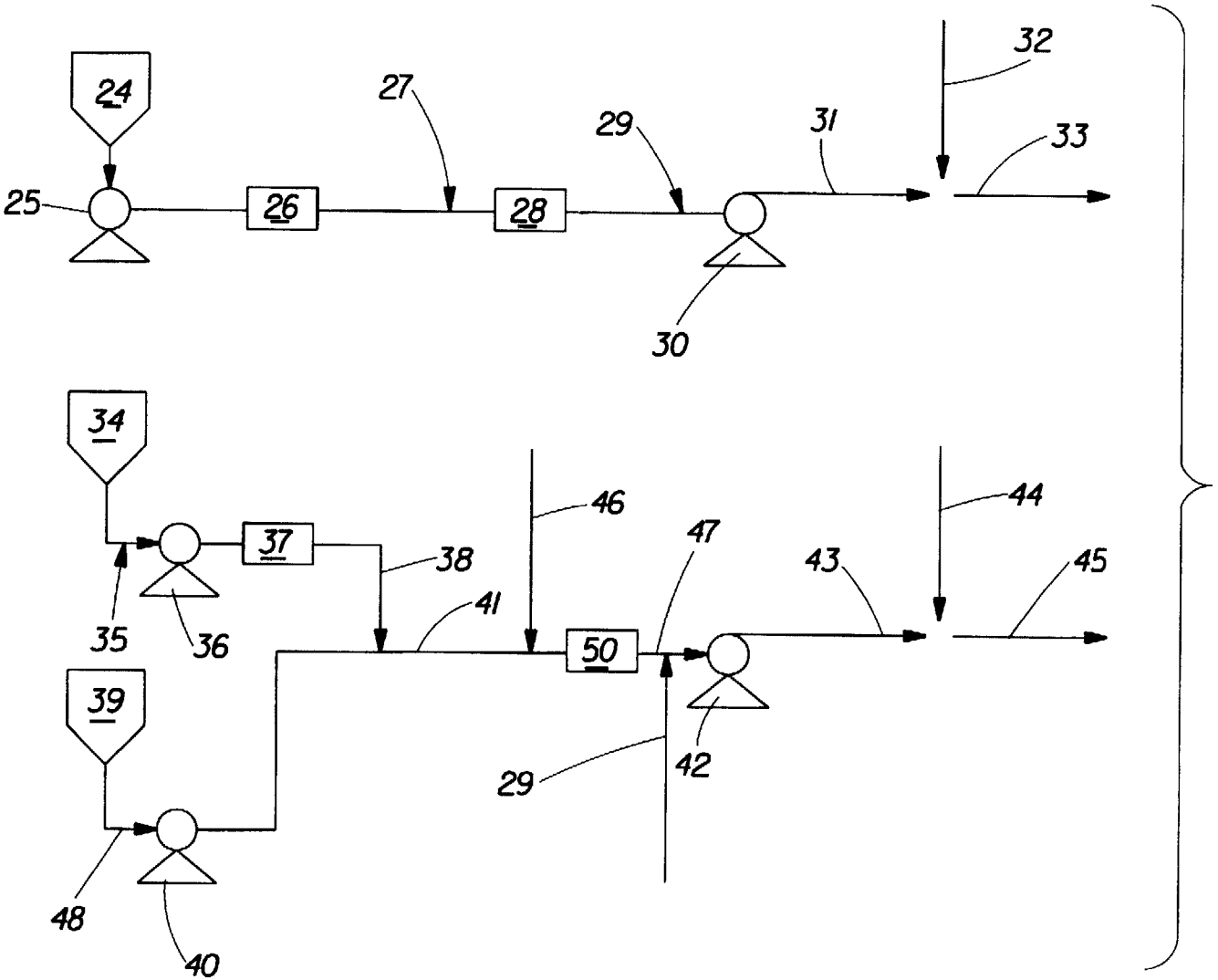
FIG. 3 is a schematic representation illustrating the steps for preparing the aqueous papermaking furnish for the papermaking process, according to another embodiment of the present invention based on anionic polyelectrolyte polymer.

Further insight into preparation methods for the aqueous papermaking furnish can be gained by reference to FIG. 2, which is a schematic representation illustrating a preparation of the aqueous papermaking furnish for the papermaking operation yielding a product according to the aspect of the invention based on starch and FIG. 3, which is a schematic representation illustrating a preparation of the aqueous papermaking furnish for the papermaking operation yielding a product according to another aspect of the invention based on anionic flocculent. The following discussion refers to FIG. 2:

A storage vessel 1 is provided for staging an aqueous slurry of relatively long papermaking fibers. The slurry is conveyed by means of a pump 2 and optionally through a refiner 3 to fully develop the strength potential of the long papermaking fibers. Additive pipe 4 conveys a resin to provide for wet or dry strength, as desired in the finished product. The slurry is then further conditioned in mixer 5 to aid in absorption of the resin. The suitably conditioned slurry is then diluted with white water 7 in a fan pump 6 forming a dilute long papermaking fiber slurry 15. Pipe 20 adds a cationic flocculant to the slurry 15, producing a flocculated long fibered slurry 22.

Still referring to FIG. 2, a storage vessel 8 is a repository for a fine particulate filler slurry. Additive pipe 9 conveys an aqueous dispersion of a cationic starch additive. Pump 10 acts to convey the fine particulate slurry as well as provide for dispersion of the starch. The slurry is conditioned in a mixer 12 to aid in absorption of the additives. Resultant slurry 13 is conveyed to a point where it is mixed with an aqueous dispersion of refined short fiber papermaking fibers.

Still referring to FIG. 2, short papermaking fiber slurry originates from a repository 11, from which it is conveyed through pipe 49 by pump 14 through a refiner 15 where it becomes a refined slurry of short papermaking fibers 16. After mixing with the conditioned slurry of fine particulate filler 13, it becomes the short fiber based aqueous papermaking slurry 17. White water 7 is mixed with slurry 17 in a fan pump 18 at which point the slurry becomes a dilute aqueous papermaking slurry 19. Pipe 21 directs a cationic flocculant into slurry 19, after which the slurry becomes a flocculated aqueous papermaking slurry 23.

Preferably, the flocculated short-fiber based aqueous papermaking slurry 23 is directed to the papermaking process illustrated in FIG. 1 and is divided into two approximately equal streams which are then directed into headbox chambers 81 and 83 ultimately evolving into wire-side-layer 73 and non-wire-side-layer 72, respectively of the strong, soft, low dusting, filled uncreped tissue paper 71. Similarly, the aqueous flocculated long papermaking fiber slurry 22, referring to FIG. 2, is preferably directed into headbox chamber 82, of FIG. 1, ultimately evolving into center layer 74 of the strong, soft, low dusting, filled uncreped tissue paper 71.

PROCESS FOR INCLUDING A FINE PARTICULATE FILLER INTO TISSUE PAPER USING AN ANIONIC POLYELECTROLYTE POLYMER

The following discussion is specific to the second embodiment of the present invention for providing the aqueous suspension of papermaking furnish comprising papermaking fibers and non-cellulosic particulate filler. This embodiment comprises the steps of:

(a) contacting an aqueous dispersion of a non-cellulosic particulate filler with an aqueous dispersion of an anionic polyelectrolyte polymer;

(b) mixing the aqueous dispersion of anionic polyelectrolyte polymer-contacted filler with papermaking fibers forming a mixture of papermaking fibers and polymer-contacted filler; and (c) contacting said mixture of papermaking fibers and polymer-contacted filler with a cationic retention aid, thereby forming said aqueous suspension of papermaking furnish.

Contacting Particulate Filler with Anionic Polyelectrolyte Polymer

The nature of the non-cellulosic particulate filler and the anionic polyelectrolyte polymer preferred for use in the present invention have been adequately discussed herein before.

In order to contact the particulate filler with the anionic polyelectrolyte polymer, the filler is first provided in an aqueous dispersion. The concentration of this dispersion is preferably as high as can conveniently be handled by pumping and conveying means available. Normally, a 70% by weight slurry of the particulate filler such as WW Fil Slurry is provided.

This slurry is then contacted by the anionic polyelectrolyte either in a batch mixing tank or continuously by means of an in-line mixer for example.

The desired usage rates of the anionic polyelectrolyte polymer will vary widely. Amounts as low as about 0.05% polymer by weight based on the dry weight of particulate filler will deliver useful results, but normally the optimum usage rate would be expected to be higher. Amounts as high as about 2% polymer by weight based on the dry weight of particulate filler might be employed, but normally between about 0.2% to about 1% is optimum.

Mixing the Anionic Polyelectrolyte and Filler with Papermaking Fibers

In preparation to be used in the present invention, it is only necessary to prepare the papermaking fibers by forming an aqueous slurry with them in a conventional repulper. In this form, it is most convenient to slurry the fibers at less than about 15%, and more preferably from about 3% to about 5% in water.

After forming an aqueous slurry of the papermaking fibers, they can be mixed by any conventional batch or continuous processes with the anionic polyelectrolyte polymer contacted particulate filler composition previously formed.

The resultant aqueous papermaking furnish is now prepared for contacting with the cationic retention aid.

Contacting the Aqueous Papermaking Furnish with the Cationic Retention Aid

Cationic Retention Aid

The term "cationic retention aid" as used herein refers to any additive which possesses multiple cationic charges capable of forming ion pairs with the anionic polyelectrolyte of the present invention to reduce its solubility in water.

There are many examples of suitable materials.

While certain multivalent cations, particularly aluminum from alum, are suitable, more preferred are polymers which carry many charges along the polymer chain. One class of suitable synthetically produced polymers originates from copolymerization of one or more ethylenically unsaturated monomers, generally acrylic monomers, that consist of or include cationic monomer.

Suitable cationic monomers are dialkyl amino alkyl-(meth) acrylates or -(meth) acrylamides, either as acid salts or quaternary ammonium salts. Suitable alkyl groups include dialkylaminoethyl (meth) acrylates, dialkylaminoethyl (meth) acrylamides and dialkylaminomethyl (meth) acrylamides and dialkylamino-1,3-propyl (meth) acrylamides. These cationic monomers are preferably copolymerized with a nonionic monomer, preferably acrylamide. Other suitable polymers are polyethylene imines, polyamide epichlorohydrin polymers, and homopolymers or copolymers, generally with acrylamide, of monomers such as diallyl dimethyl ammonium chloride.

These are preferably relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One suitable material is Cypro 514®, a product of Cytec, Inc. of Stamford, Conn.

The most preferred cationic retention aid for use with the present invention is cationic starch. The present invention preferably utilizes a cationic starch, added in amounts from about 0.05% to about 2%, but most preferably from about 0.2% to about 1%, by weight based on the weight of the tissue paper. Cationic starch has been adequately described herein before.

Contacting the Aqueous Furnish and the Cationic Retention Aid

The cationic retention aid is added to the aqueous papermaking furnish which is comprised of a mixture of papermaking fibers and a anionic polyelectrolyte polymer-contacted particulate filler composition. The cationic retention aid, preferably cationic starch, can be added at any suitable point in the approach flow of the stock preparation system of the papermaking process. It is particularly preferred to add the cationic retention aid prior to the fan pump in which the final dilution with the recycled machine water returned from the process is made. Aside from the slowed effectiveness due to the dilution, the machine water contains a large amount of fine material which can preferentially attract the retention aid and reduce its effectiveness. The consistency of the aqueous papermaking furnish at the point of addition of the cationic retention aid is preferably greater than about 1% and most preferably greater than about 3%.

The cationic retention aid is delivered as an aqueous dispersion. Preferably, the solids content of the aqueous dispersion of the cationic retention aid is less than about 10% solids. More preferably it will be between about 0.1% and about 5%.

The following discussion refers to FIG. 3:

A storage vessel 24 is provided for staging an aqueous slurry of relatively long papermaking fibers. The slurry is conveyed by means of a pump 25 and optionally through a refiner 26 to fully develop the strength potential of the long papermaking fibers. Additive pipe 27 conveys a resin to provide for wet or dry strength, as desired in the finished product. The slurry is then further conditioned in mixer 28 to aid in absorption of the resin. The suitably conditioned slurry is then diluted with white water 29 in a fan pump 30 forming a dilute long papermaking fiber slurry 31. Optionally, pipe 32 conveys an flocculant to mix with slurry 31, forming an aqueous flocculated long fiber papermaking slurry 33.

Still referring to FIG. 3, a storage vessel 34 is a repository for a fine particulate filler slurry. Additive pipe 35 conveys an aqueous dispersion of an anionic polyelectrolyte polymer. Pump 36 acts to convey the fine particulate slurry as well as provide for dispersion of the polymer. The slurry is conditioned in a mixer 37 to aid in absorption of the additive. Resultant slurry 38 is conveyed to a point where it is mixed with an aqueous dispersion of short papermaking fibers.

Still referring to FIG. 3, a short papermaking fiber slurry originates from a repository 39, from which it is conveyed through pipe 48 by pump 40 to a point where it mixes with the conditioned fine particulate filler slurry 38 to become the short fiber based aqueous papermaking slurry 41. Pipe 46 conveys an aqueous dispersion of cationic starch which mixes with slurry 41, aided by in line mixer 50, to form flocculated slurry 47. White water 29 is directed into the flocculated slurry which mixes in fan pump 42 to become the dilute flocculated short fiber based aqueous papermaking slurry 43. Optionally, pipe 44 conveys additional flocculant to increase the level of flocculation of dilute slurry 43 forming slurry 45.

Preferably, the short papermaking fiber slurry 45 from FIG. 3 is directed to the preferred papermaking process illustrated in FIG. 1 and is divided into two approximately equal streams which are then directed into headbox chambers 83 and 81 ultimately evolving into wire-side-layer 73 and non-wire-side-layer 72, respectively of the strong, soft, low dusting, filled uncreped tissue paper 71. Similarly, the long papermaking fiber slurry 33, referring to FIG. 3, is preferably directed into headbox chamber 82, of FIG. 1, ultimately evolving into center layer 74 of the strong, soft, low dusting, filled uncreped tissue paper 71.

Additional Furnishes

In either embodiment of the present invention, multiple papermaking furnishes are preferably provided. In this case, it is desirable for the papermaking fibers used to contact the fine particulate filler be of the hardwood type, preferably at least about 80% hardwood. In this aspect, at least one additional furnish would be provided, preferably predominantly of longer, and coarser fibered softwood type, preferably of greater than 80% softwood content. This latter furnish, preferably of softwood type, is preferably maintained relatively free of the fine particulate filler.

In a most preferred aspect of the present invention, these furnishes would be discharged onto foraminous papermaking clothing in such a manner so that they are maintained in separate layers through the paper forming process. One specifically desirable practice, is to relegate the particulate-filler contacted papermaking fibers into a multi-layered tissue paper web wherein three layers are provided. The three layers comprise two outer layers formed from the particulate filler contacted papermaking fibers surrounding an inner layer formed from a furnish relatively free of fine particulate fillers.

Optional Chemical Additives

Other materials can be added to the aqueous papermaking furnish or the embryonic web to impart other characteristics to the product or improve the papermaking process so long as they are compatible with the chemistry of the selected particulate filler and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. Many experts in the field believe that a cationic charge biasing species is desirable as it partially neutralizes these solids, making them more easily flocculated by cationic flocculants such as the before mentioned cationic starch and cationic polyelectrolyte. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One suitable material is Cypro 514®, a product of Cytec, Inc. of Stamford, Conn. The use of such materials is expressly allowed within the practice of the present invention. Caution should be used in their application, however. It is well known that while a small amount of such agents can actually aid retention by neutralizing anionic centers inaccessible to the larger flocculant molecules and thereby lowering the particle repulsion; however, since such materials can compete with cationic flocculants for anionic anchoring sites, they can actually have an effect opposite to the intended one by negatively impacting retention when anionic sites are limited.

The use of high surface area, high anionic charge microparticles for the purposes of improving formation, drainage, strength, and retention is well taught in the art. See, for example, U. S. Pat. No. 5,221,435, issued to Smith on Jun. 22, 1993, incorporated herein by reference. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene latices; insolubilized polyvinyl alcohol; urea-formaldehyde; polyethyleneimine; chitosan polymers and mixtures thereof can be added to the papermaking furnish or to the embryonic web. Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymene 557H®.

Many creped paper products must have limited strength when wet because of the need to dispose of them through toilets into septic or sewer systems. If wet strength is imparted to these products, it is preferred to be fugitive wet strength characterized by a decay of part or all of its potency upon standing in presence of water. If fugitive wet strength is desired, the binder materials can be chosen from the group consisting of dialdehyde starch or other resins with aldehyde functionality such as Co-Bond 1000® offered by National Starch and Chemical Company, Parez 750® offered by Cytec of Stamford, Conn. and the resin described in U.S. Pat. No. 4,981,557 issued on Jan. 1, 1991, to Bjorkquist and incorporated herein by reference.

If enhanced absorbency is needed, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40® which is available from Croda, Inc. (New York, N.Y.); alkylglycoside ethers as described in U.S. Pat. No. 4,011,389, issued to W. K. Langdon, et al. on March 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.).

Chemical softening agents are expressly included as optional ingredients. Acceptable chemical softening agents comprise the well known dialkyldimethylammonium salts such as ditallowdimethylammonium chloride, ditallowdimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename Varisoft 137®. Biodegradable mono and di-ester variations of the quaternary ammonium compound can also be used and are within the scope of the present invention.

The above listings of optional chemical additives is intended to be merely exemplary in nature, and are not meant to limit the scope of the invention.

The Uncreped Tissue Papermaking Process

FIG. 1A is a schematic representation illustrating a unereped papermaking process for producing a strong, soft, and low dust filled unereped tissue paper. These preferred embodiments are described in the following discussion, wherein reference is made to FIG. 1A.

FIG. 1A is a side elevational view of a preferred papermaking machine for manufacturing uncreped tissue paper webs according to the present invention. Referring to FIG. 1A, the papermaking machine comprises a layered headbox 80 having a top chamber 81 a center chamber 82, and a bottom chamber 83, a slice roof 84, and a foraminous forming fabric (e.g. a Fourdrinier wire) 85 which is looped over and about breast roll 88 and a plurality of turning rolls shown but not numbered for simplicity. In operation, one papermaking furnish is pumped through top chamber 81 a second papermaking furnish is pumped through center chamber 82, while a third furnish is pumped through bottom chamber 83 and thence out of the slice roof 84 in over and under relation onto Fourdrinier wire 85 to form thereon a multi-layered embryonic web 98. Dewatering occurs through the Fourdrinier wire 85 and can be assisted by deflectors or vacuum boxes which for simplicity are not shown. As the Fourdrinier wire makes its return, showers, not shown, clean it prior to its commencing another pass over breast roll 88. The embryonic web supported by Fourdrinier wire 85 is transferred to a foraminous transfer (i.e. carrier) fabric 86 by the action of vacuum transfer box 87. Carrier fabric 86 travels at a slower speed than Fourdrinier wire 85. The purpose of carrier fabric 86 is therefore to shorten the embryonic web 98 relative to its length while being supported on Fourdrinier wire 85. A further purpose of carrier fabric 86 is to transport the embryonic web to a blow through dryer fabric 90. During this travel, the embryonic web can optionally be further dewatered by means of vacuum boxes not shown. The path of carrier fabric 86 is controlled by a plurality of turning rolls shown but not numbered for simplicity. The transfer to the blow through dryer fabric 90 is effected by means of a vacuum box 91. Carrier fabric 86 is preferably showered by means not shown prior to its return to the web transfer zone promoted by vacuum box 87. After transfer to the blow through dryer fabric 90, the wet web is transported through blow through dryer 92, whereupon, hot air generated by means not shown is propelled through the dryer fabric and consequently the embryonic web which resides thereupon. The dried web 93 is dislodged from the dryer fabric 90 at the exit of the predryer. At this point, dried web 93 can optionally be directed between two, relatively smooth, dry end carrying fabrics, an upper fabric 96 and a lower fabric 94. While secured between fabrics 96 and 94, the dried web 93 can be calendered by a series of fixed gap calendering nips formed between opposing pairs of rollers 95. These nips smooth the surface and control the thickness of the tissue paper.

Still referring to FIG. 1A, the finished calendered web 71 emerges from the space between opposing carrier fabrics 96 and 94 still supported by carrier fabric 94 after which it is wound upon reel 98. The finished web 71 is comprised of three layers as revealed in the detailed drawing inset of FIG. 1 B. The detail drawing inset FIG. 1 B reveals outer layers 73 and 72 consisting of a wire side layer 73 and a non-wire-side layer 72 and a inner layer 74 between the outer layers 73 and 72. The genesis of layers 73, 72 and 74 are the furnishes of headbox chambers 83, 81 and 82 respectively. Although FIG. 1A shows a papermachine having headbox 80 adapted to make a three-layer web, headbox 80 can alternatively be adapted to make unlayered, two layer or other multi-layer webs.

Further, with respect to making paper sheet 71 embodying the present invention on papermaking machine of FIG. 1, the Fourdrinier wire 85 must be of a fine mesh having relatively small spans with respect to the average lengths of the fibers constituting the short fiber furnish so that good formation will occur. The preferred characteristics of the clothing elements 86, 90, 94, and 96 specific to this class of papermaking are adequately discussed in the prior art. For example, Hyland, in European Patent Application 0 617 164 A1, published Sep. 28, 1994 and incorporated herein by reference discusses the preferred characteristics of the before-mentioned clothing.

The filled tissue paper webs made according to the present invention have a basis weight of between 10 g/m$^2$ and about 100 g/m$^2$. In its preferred embodiment, the filled uncreped tissue paper made by the present invention has a basis weight between about 10 g/m$^2$ and about 50 g/m$^2$ and, most preferably, between about 10 g/m$^2$ and about 30 g/m$^2$. Uncreped tissue paper webs prepared by the present invention possess a density of about 0.60 g/cm$^3$ or less. In its preferred embodiment, the filled uncreped issue paper of the present invention has a density between about 0.03 g/cm$^3$ and about 0.6 g/cm$^3$ and, most preferably, between about 0.05 g/cm$^3$ and 0.2 g/cm$^3$.

The present invention is further applicable to the production of multi-layered tissue paper webs. Multilayered tissue structures and methods of forming multilayered tissue structures are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference. The layers are preferably comprised of different fiber types, the fibers typically being relatively long softwood and relatively short hardwood fibers as used in multi-layered tissue paper making. Multi-layered tissue paper webs resultant from the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fibers having an average fiber length of least about 2.0 mm. These long paper making fibers are typically softwood fibers, preferably, northern softwood Kraft fibers. Preferably, the majority of the particulate filler of the present invention is contained in at least one of the outer layers of the multi-layered tissue paper web of the present invention. More preferably, the majority of the particulate filler of the present invention is contained in both of the outer layers.

The uncreped tissue paper products made from single-layered or multi-layered uncreped tissue paper webs can be single-ply tissue products or multi-ply tissue products.

In typical practice of the present invention, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering.

To prepare filled tissue paper products according to the method of the present invention, an aqueous papermaking furnish is deposited on a foraminous surface to form an embryonic web. The scope of the invention also includes processes for making tissue paper product by the formation of multiple paper layers in which two or more layers of furnish are preferably formed from the deposition of separate streams of dilute fiber slurries for example in a multi-channeled headbox. The layers are preferably comprised of different fiber types, the fibers typically being relatively long softwood and relatively short hardwood fibers as used in multi-layered tissue paper making. If the individual layers are initially formed on separate wires, the layers are subsequently combined when wet to form a multi-layered layered tissue paper web. The papermaking fibers are preferably comprised of different fiber types, the fibers typically being relatively long softwood and relatively short hardwood fibers. More preferably, the hardwood fibers comprise at least about 50% and said softwood fibers comprise at least about 10% of said papermaking fibers.

The advantages related to the practice of the present invention include the ability to reduce the amount of papermaking fibers required to produce a given amount of tissue paper product. Further, the optical properties, particularly the opacity, of the tissue product are improved.

These advantages are realized in a tissue paper web which has a high level of strength and is low dusting.

The term "opacity" as used herein refers to the resistance of a tissue paper web from transmitting light of a wavelength corresponding to the visible portion of the electromagnetic spectrum. The "specific opacity" is the measure of the degree of opacity imparted for each 1 g/m$^2$ unit of basis weight of a tissue paper web. The method of measuring opacity and calculating specific opacity are detailed in a later section of this specification. Tissue paper webs according to the present invention preferably have more than about 5%, more preferably more than about 5.5%, and most preferably more than about 6% specific opacity.

The term "strength" as used herein refers to the specific total tensile strength, the determination method for this measure is included in a later section of this specification. The tissue paper webs according to the present invention are strong. This generally means that their specific total tensile strength is at least about 0.25 meters, more preferably more than about 0.40 meters.

The terms "lint" and "dust" are used interchangeably herein and refer to the tendency of a tissue paper web to release fibers or particulate fillers as measured in a controlled abrasion test, the methodology for which is detailed in a later section of this specification. Lint and dust are related to strength since the tendency to release fibers or particles is directly related to the degree to which such fibers or particles are anchored into the structure. As the overall level of anchoring is increased, the strength will be increased. However, it is possible to have a level of strength which is regarded as acceptable but have an unacceptable level of linting or dusting. This is because linting or dusting can be localized. For example, the surface of a tissue paper web can be prone to linting or dusting, while the degree of bonding beneath the surface can be sufficient to raise the overall level of strength to quite acceptable levels. In another case, the strength can be derived from a skeleton of relatively long papermaking fibers, while fiber fines or the particulate filler can be insufficiently bound within the structure. The filled tissue paper webs made according to the present invention are relatively low in lint. Levels of lint below about 12 are preferable, below about 10 are more preferable, and below 8 are most preferable.

The multi-layered tissue paper web made according to the present invention can be used in any application where soft, absorbent multi-layered tissue paper webs are required. Particularly advantageous uses of the multi-layered tissue paper web of this invention are in toilet tissue and facial tissue products. Both single-ply and multi-ply tissue paper products can be produced from the webs of the present invention.

Analytical and Testing Procedures

A. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

B. Molecular Weight Determination

The essential distinguishing characteristic of polymeric materials is their molecular size. The properties which have enabled polymers to be used in a diversity of applications derive almost entirely from their macro-molecular nature. In order to characterize fully these materials it is essential to have some means of defining and determining their molecular weights and molecular weight distributions. It is more correct to use the term relative molecular mass rather the molecular weight, but the latter is used more generally in polymer technology. It is not always practical to determine molecular weight distributions. However, this is becoming more common practice using chromatographic techniques. Rather, recourse is made to expressing molecular size in terms of molecular weight averages.

Molecular Weight Averages

If we consider a simple molecular weight distribution which represents the weight fraction ($w_i$) of molecules having relative molecular mass ($M_i$), it is possible to define several useful average values. Averaging carried out on the basis of the number of molecules ($N_i$) of a particular size ($M_i$) gives the Number Average Molecular Weight $$\overline{M}_n = \frac{\Sigma N_i M_i}{\Sigma N_i}$$

monodisperse molecular species, i.e. molecules having the same molecular weight. Of more significance is the recognition that if the number of molecules in a given mass of a polydisperse polymer can be determined in some way then $\overline{M}n$, can be calculated readily. This is the basis of colligative property measurements.

Averaging on the basis of the weight fractions ($W_i$) of molecules of a given mass ($M_i$) leads to the definition of Weight Average Molecular Weights $$\overline{M}_w = \frac{\Sigma W_i N_i}{\Sigma W_i} = \frac{\Sigma N_i M_i^2}{\Sigma N_i M_i}$$

$\overline{M}w$ is a more useful means for expressing polymer molecular weights than $\overline{M}n$ since it reflects more accurately such properties as melt viscosity and mechanical properties of polymers and is therefor used in the present invention.

C. Filler Particle Size Determination

Particle size is an important determinant of performance of filler, especially as it relates to the ability to retain it in a paper sheet. Clay particles, in particular, are platy or blocky, not spherical, but a measure referred to as "equivalent spherical diameter" can be used as a relative measure of odd shaped particles and this is one of the main methods that the industry uses to measure the particle size of clays and other particulate fillers. Equivalent spherical diameter determinations of fillers can be made using TAPPI Useful Method 655, which is based on the Sedigraph® analysis, i.e., by the instrument of such type available from the Micromeritics Instrument Corporation of Norcross, Ga. The instrument uses soft x-rays to determine gravity sedimentation rate of a dispersed slurry of particulate filler and employs Stokes Law to calculate the equivalent spherical diameter.

D. Filler Quantitative Analysis in Paper

Those skilled in the art will recognize that there are many methods for quantitative analysis of non-cellulosic filler materials in paper. To aid in the practice of this invention, two methods will be detailed applicable to the most preferred inorganic type fillers. The first method, ashing, is applicable to inorganic fillers in general. The second method, determination of kaolin by XRF, is tailored specifically to the filler found particularly suitable in the practice of the present invention, i.e. kaolin.

Ashing

Ashing is performed by use of a muffle furnace. In this method, a four place balance is first cleaned, calibrated and tarred. Next, a clean and empty platinum dish is weighed on the pan of the four place balance. Record the weight of the empty platinum dish in units of grams to the ten-thousandths place. Without re-tarring the balance, approximately 10 grams of the filled tissue paper sample is carefully folded into the platinum dish. The weight of the platinum boat and paper is recorded in units of grams to the ten-thousandths place.

The paper in the platinum dish is then pre-ashed at low temperatures with a Bunsen burner flame. Care must be taken to do this slowly to avoid the formation of air-borne ash. If air-borne ash is observed, a new sample must be prepared. After the flame from this pre-ashing step has subsided, place the sample in the muffle furnace. The muffle furnace should be at a temperature of 575° C. Allow the sample to completely ash in the muffle furnace for approximately 4 hours. After this time, remove the sample with thongs and place on a clean, flame retardant surface. Allow the sample to cool for 30 minutes. After cooling, weigh the platinum dish/ash combination in units of grams to the ten-thousandths place. Record this weight.

The ash content in the filled tissue paper is calculated by subtracting the weight of the clean, empty platinum dish from the weight of the platinum dish/ash combination. Record this ash content weight in units of grams to the ten-thousandths place.

The ash content weight may be converted to a filler weight by knowledge of the filler loss on ashing (due for example to water vapor loss in kaolin). To determine this, first weigh a clean and empty platinum dish on the pan of a four place balance. Record the weight of the empty platinum dish in units of grams to the ten-thousandths place. Without re-tarring the balance, approximately 3 grams of the filler is carefully poured into the platinum dish. The weight of the platinum dish/filler combination is recorded in units of grams to the ten-thousandths place.

This sample is then carefully placed in the muffle furnace at 575° C. Allow the sample to completely ash in the muffle furnace for approximately 4 hours. After this time, remove the sample with thongs and place on a clean, flame retardant surface. Allow the sample to cool for 30 minutes. After cooling, weigh the platinum dish/ash combination in units of grams to the ten-thousandths place. Record this weight.

Calculate the percent loss on ashing in the original filler sample using the following equation:

$$\%\ \text{Loss on ashing} = \frac{[(\text{Wt. of Original Filler Sample \& pt dish}) - (\text{Wt. of Filler Ash \& pt dish})] \times 100}{[(\text{Wt. of Original Filler Sample \& pt dish}) - (\text{Wt of pt dish})]}$$

The % loss on ashing in kaolin is 10 to 15%. The original ash weight in units of grams can then be converted to a filler weight in units of grams with the following equation:

$$\text{Weight of Filler (g)} = \frac{\text{Weight of Ash (g)}}{[1 - (\%\ \text{Loss on Ashing}/100)]}$$

The percent filler in the original filled tissue paper can then be calculated as follows:

$$\%\ \text{Filler in Tissue Paper} = \frac{\text{Weight of Filler (g)} \times 100}{[(\text{Weight of Platinum Dish \& Paper}) - (\text{Weight of Platinum Dish})]}$$

Determination of Kaolin Clay by XRF

The main advantage of the XRF technique over the muffle furnace ashing technique is speed, but it is not as universally applicable. The XRF spectrometer can quantitate the level of kaolin clay in a paper sample within 5 minutes compared to the hours it takes in the muffle furnace ashing method.

The X-ray Fluorescence technique is based on the bombardment of the sample of interest with X-ray photons from a X-ray tube source. This bombardment by high energy photons causes core level electrons to be photoemitted by the elements present in the sample. These empty core levels are then filled by outer shell electrons. This filling by the outer shell electrons results in the fluorescence process such that additional X-ray photons are emitted by the elements present in the sample. Each element has distinct "fingerprint" energies for these X-ray fluorescent transitions. The energy and thus the identity of the element of interest of these emitted X-ray fluorescence photons is determined with a lithium doped silicon semiconductor detector. This detector makes it possible to determine the energy of the impinging photons and thus the identify the elements present in the sample. The elements from sodium to uranium may be identified in most sample matrices.

In the case of the clay fillers, the detected elements are both silicon and aluminum. The particular X-ray Fluorescence instrument used in this clay analysis is a Spectrace 5000 made by Baker-Hughes Inc. of Mountain View, Calif. The first step in the quantitative analysis of clay is to calibrate the instrument with a set of known clay filled tissue standards, using clay inclusions ranging from 8% to 20%, for example.

The exact clay level in these standard paper samples is determined with the muffle furnace ashing technique described above. A blank paper sample is also included as one of the standards. At least 5 standards bracketing the desired target clay level should be used to calibrate the instrument.

Before the actual calibration process, the X-ray tube is powered to settings of 13 kilovolts and 0.20 milliamps. The instrument is also set up to integrate the detected signals for the aluminum and silicon contained in the clay. The paper sample is prepared by first cutting a 2" by 4" strip. This strip is then folded to make a 2"×2" with the off-Yankee side facing out. This sample is placed on top of the sample cup and held in place with a retaining ring. During sample preparation, care must be taken to keep the sample flat on top of the sample cup. The instrument is then calibrated using this set of known standards.

After calibrating the instrument with the set of known standards, the linear calibration curve is stored in the computer system's memory. This linear calibration curve is used to calculate clay levels in the unknowns. To insure the X-ray Fluorescence system is stable and working properly, a check sample of known clay content is run with every set of unknowns. If the analysis of the check sample results in an inaccurate result (10 to 15% off from its known clay content), the instrument is subjected to trouble-shooting and/or re-calibrated.

For every paper-making condition, the clay content in at least 3 unknown samples is determined. The average and standard deviation is taken for these 3 samples. If the clay application procedure is suspected or intentionally set up to vary the clay content in either the cross direction (CD) or machine direction (MD) of the paper, more samples should be measured in these CD and MD directions.

E. Measurement of Tissue Paper Lint

The amount of lint generated from a tissue product is determined with a Sutherland Rub Tester. This tester uses a motor to rub a weighted felt 5 times over the stationary toilet tissue. The Hunter Color L value is measured before and after the rub test. The difference between these two Hunter Color L values is calculated as lint.

SAMPLE PREPARATION

Prior to the lint rub testing, the paper samples to be tested should be conditioned according to Tappi Method #T4020M-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C. This rub testing should also take place within the confines of the constant temperature and humidity room.

The Sutherland Rub Tester may be obtained from Testing Machines, Inc. (Amityville, N.Y., 11701). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the wire side out and 3 with the non-wire side out. Keep track of which samples are wire side out and which are non-wire side out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip.

If working with multi-ply converted product, there will now be 3 samples on the cardboard. For single-ply finished product, there will now be 3 wire side out samples on cardboard and 3 non-wire side out samples on cardboard.

FELT PREPARATION

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625." Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snuggly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "W." Mark the next highest number with the letter "N." Continue marking the samples in this alternating "W"/"N" pattern. Use the "W" samples for wire side out lint analyses and the "N" samples for non-wire side lint analyses. For 1-ply product, there are now a total of 24 samples for the new lot of felt and the old lot of felt. Of this 24, twelve are for wire side out lint analysis and 12 are for non-wire side lint analysis.

Rub and measure the Hunter Color L values for all 24 samples of the old felt as described below. Record the 12 wire side Hunter Color L values for the old felt. Average the 12 values. Record the 12 non-wire side Hunter Color L values for the old felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 wire side Hunter Color L values for the new felt. Average the 12 values. Record the 12 non-wire side Hunter Color L values for the new felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

CARE OF 4 POUND WEIGHT

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

RUB TESTER INSTRUMENT CALIBRATION

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

HUNTER COLOR METER CALIBRATION

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

MEASUREMENT OF SAMPLES

The first step in the measurement of lint is to measure the Hunter color values of the black felt/cardboard samples prior to being rubbed on the tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboards are used until they are bent, torn, limp, or no longer have a smooth surface.

CALCULATIONS

Determine the delta L values by subtracting the average initial L reading found for the unused felts from each of the measured values for the wire side and the non-wire side of the sample. Recall, multi-ply-ply product will only rub one side of the paper. Thus, three delta L values will be obtained for the multi-ply product. Average the three delta L values and subtract the felt factor from this final average. This final result is termed the lint for the 2-ply product.

For the single-ply product where both wire side and non-wire side measurements are obtained, subtract the average initial L reading found for the unused felts from each of the three wire side L readings and each of the three non-wire side L readings. Calculate the average delta for the three wire side values. Calculate the average delta for the three non-wire side values. Subtract the felt factor from each of these averages. The final results are termed a lint for the non-wire side and a lint for the wire side of the single-ply product. By taking the average of these two values, an ultimate lint is obtained for the entire single-ply product.

F. Measurement of Panel Softness of Tissue Papers

Ideally, prior to softness testing, the paper samples to be tested should be conditioned according to Tappi Method #T4020M-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

G. Measurement of Opacity of Tissue Papers

The percent opacity is measured using a Colorquest DP-9000 Spectrocolorimeter. Locate the on/off switch on the back of the processor and turn it on. Allow the instrument to warm up for two hours. If the system has gone into standby mode, press any key on the key pad and allow the instrument 30 minutes of additional warm-up time.

Standardize the instrument using the black glass and white tile. Make sure the standardization is done in the read mode and according to the instructions given in the standardization section of the DP9000 instrument manual. To standardize the DP-9000, press the CAL key on the processor and follow the prompts as shown on the screen. You are then prompted to read the black glass and the white tile.

The DP-9000 must also be zeroed according the instructions given in the DP-9000 instrument manual. Press the setup key to get into the setup mode. Define the following parameters:

UF filter: OUT
Display: ABSOLUTE
Read Interval: SINGLE
Sample ID: ON or OFF
Average: OFF
Statistics: SKIP
Color Scale: XYZ
Color Index: SKIP
Color Difference Scale: SKIP
Color Difference Index: SKIP
CMC Ratio: SKIP
CMC Commercial Factor: SKIP
Observer: 10 degrees
Illuminant: D
M1 2nd illuminant: SKIP
Standard: WORKING
Target Values: SKIP
Tolerances: SKIP Confirm the color scale is set to XYZ, the observer set to 10 degrees, and the illuminant set to D. Place the one ply sample on the white uncalibrated tile. The white calibrated tile can also be used. Raise the sample and tile into place under the sample port and determine the Y value.

Lower the sample and tile. Without rotating the sample itself, remove the white tile and replace with the black glass. Again, raise the sample and black glass and determine the Y value. Make sure the 1-ply tissue sample is not rotated between the white tile and black glass readings.

The percent opacity is calculated by taking the ratio of the Y reading on the black glass to the Y reading on the white tile. This value is then multiplied by 100 to obtain the percent opacity value.

For the purposes of this specification, the measure of opacity is converted into a "specific opacity", which, in effect, corrects the opacity for variations in basis weight. The formula to convert opacity % into specific opacity % is as follows:

$$\text{Specific Opacity}=(1-(\text{Opacity}/100)^{(1/\text{Basis Weight})})\times 100,$$

where the specific opacity unit is per cent for each $g/m^2$, opacity is in units of per cent, and basis weight is in units of $g/m^2$.

Specific opacity should be reported to 0.01%.

G. Measurement of Strength of Tissue Papers

DRY TENSILE STRENGTH

The tensile strength is determined on one inch wide strips of sample using a Thwing-Albert Intelect II Standard Tensile Tester (Thwing-Albert Instrument Co., 10960 Dutton Rd., Philadelphia, Pa., 19154). This method is intended for use on finished paper products, reel samples, and unconverted stocks.

SAMPLE CONDITIONING AND PREPARATION

Prior to tensile testing, the paper samples to be tested should be conditioned according to Tappi Method #T4020M-88. All plastic and paper board packaging materials must be carefully removed from the paper samples prior to testing. The paper samples should be conditioned for at least 2 hours at a relative humidity of 48 to 52% and within a temperature range of 22° to 24° C. Sample preparation and all aspects of the tensile testing should also take place within the confines of the constant temperature and humidity room.

For finished product, discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co., 10960 Dutton Road, Philadelphia, Pa., 19154) to make 4 separate stocks. Make sure stacks 1 and 3 are still identified for machine direction testing and stacks 2 and 4 are identified for cross direction testing.

Cut two 1" wide strips in the machine direction from stacks 1 and 3. Cut two 1" wide strips in the cross direction from stacks 2 and 4. There are now four 1" wide strips for machine direction tensile testing and four 1" wide strips for cross direction tensile testing. For these finished product samples, all eight 1" wide strips are five usable units (also termed sheets) thick.

For unconverted stock and/or reel samples, cut a 15" by 15" sample which is 8 plies thick from a region of interest of the sample using a paper cutter (JDC-1-10 or JDC-1-12 with safety shield from Thwing-Albert Instrument Co., 10960 Dutton Road, Philadelphia, Pa., 19154) . Make sure one 15" cut runs parallel to the machine direction while the other runs parallel to the cross direction. Make sure the sample is conditioned for at least 2 hours at a relative humidity of 48 to 52% and within a temperature range of 22° to 24° C. Sample preparation and all aspects of the tensile testing should also take place within the confines of the constant temperature and humidity room.

From this preconditioned 15" by 15" sample which is 8 plies thick, cut four strips 1" by 7" with the long 7" dimension running parallel to the machine direction. Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co., 10960 Dutton Road, Philadelphia, Pa., 19154). There are now a total of eight samples: four 1" by 7" strips which are 8 plies thick with the 7" dimension running parallel to the machine direction and four 1" by 7" strips which are 8 plies thick with the 7" dimension running parallel to the cross direction.

OPERATION OF TENSILE TESTER

For the actual measurement of the tensile strength, use a Thwing-Albert Intelect II Standard Tensile Tester (Thwing-Albert Instrument Co., 10960 Dutton Rd., Philadelphia, Pa., 19154). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 2.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

CALCULATIONS

For the four machine direction 1" wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

For purposes of this specification, the tensile strength should be converted into a "specific total tensile strength" defined as the sum of the tensile strength measured in the machine and cross machine directions, divided by the basis weight, and corrected in units to a value in meters.

What is claimed is:

1. A process for incorporating a non-cellulosic particulate filler into a low dusting, uncreped tissue paper, said process comprising the steps of:

(a) providing an aqueous suspension of papermaking furnish comprising papermaking fibers, between about 1 percent and about 50 percent of the total weight of said uncreped tissue paper non-cellulosic particulate filler, and a retention aid for said particulate filler, said retention aid being selected from a group consisting of cationic starch and anionic polyelectrolytes, wherein said particulate filler is selected from the group consisting of clay, calcium carbonate, titanium dioxide, talc, aluminum silicate, calcium silicate, alumina trihydrate, activated carbon, calcium sulfate, glass microspheres, diatomaceous earth, and mixtures thereof, (b) depositing said aqueous suspension of papermaking furnish onto the surface of a traveling foraminous forming fabric to form a wet embryonic papermaking web, (c) transferring said wet embryonic papermaking web from the forming fabric to a first transfer fabric traveling at a speed from about 5% to about 75% slower than the forming fabric; and (d) transferring the wet embryonic papermaking web from the first transfer fabric via at least one further transfer to a dying fabric, whereupon said wet embryonic papermaking web is non-compressively dried so as to provide a low dusting, filled uncreped tissue paper having a lint level less than about 12 and a density less than about 0.60 grams per cubic centimeter.

2. The process of claim 1 wherein said particulate filler is kaolin clay having an average equivalent spherical diameter between about 0.5μ and about 5μ.

3. The process of claim 2 wherein the wet embryonic papermaking web is dried by throughdrying.

4. The process of claim 1 in which the aqueous suspension of papermaking furnish of step (a) is provided by a process comprising the steps of:

(a) contacting an aqueous dispersion of said non-cellulosic particulate filler with an aqueous dispersion of said cationic starch;

(b) mixing the aqueous dispersion of starch-contacted filler with papermaking fibers forming a mixture of papermaking fibers and starch-contacted filler; and (c) contacting said mixture of papermaking fibers and starch-contacted filler with a flocculant, thereby forming said aqueous suspension of papermaking furnish.

5. The process of claim 4 wherein said starch has a degree of substitution ranging from about 0.01 to about 0.1 cationic substituent per anhydroglucose units of starch; said cationic substituent selected from the group consisting of tertiary aminoalkyl ethers, quaternary ammonium alkyl ethers and mixtures thereof.

6. The process of claim 5 wherein said aqueous dispersion of non-cellulosic particulate filler contains between about 0.1% and about 5% by weight of particulate filler and said aqueous dispersion of starch contains between about 0.1% and about 10% by weight of starch.

7. The process of claim 6 wherein said starch comprises from about 0.1% to about 5% by weight based on the weight of said particulate filler.

8. The process of claim 7 comprising the additional step of refining the papermaking fibers to a freeness less than about 600 ml Canadian Standard Freeness prior to contact with said particulate filler.

9. The process of claim 8 wherein said flocculant is a cationic polyacrylamide polymer containing from about 0.2 to about 2.5 milliequivalents of cationic substituent per gram of polymer and having a molecular weight of at least about 1,000,000.

10. The process of claim 9 wherein said particulate filler is kaolin clay having an average equivalent spherical diameter between about 0.5μ and about 5μ.

11. The process of claim 10 wherein the wet embryonic papermaking web is dried by throughdrying.

12. The process of claim 1 in which the aqueous suspension of papermaking furnish of step (a) is provided by a process comprising the steps of:

(a) contacting an aqueous dispersion of said non-cellulosic particulate filler with an aqueous dispersion of said anionic polyelectrolyte polymer;

(b) mixing the aqueous dispersion of anionic polyelectrolyte polymer-contacted filler with papermaking fibers forming a mixture of papermaking fibers and polymer-contacted filler; and (c) contacting said mixture of papermaking fibers and polymer-contacted filler with a cationic retention aid, thereby forming said aqueous suspension of papermaking furnish.

13. The process of claim 12 wherein said anionic polyelectrolyte polymer has a molecular weight greater than about 1,000,000 and has a charge density of from about 2 to about 4 milliequivalents per gram of polymer.

14. The process of claim 13 wherein said anionic polyelectrolyte polymer comprises from about 0.2% to about 1% by weight based on the weight of said particulate filler.

15. The process of claim 14 wherein the cationic retention aid of step (c) is a cationic starch having a degree of substitution ranging from about 0.01 to about 0.1 cationic substituent per anhydroglucose units of starch and said cationic substituent is selected from the group consisting of tertiary aminoalkyl ethers, quaternary ammonium alkyl ethers and mixtures thereof.

16. The process of claim 15 wherein said starch is added at a rate of about 0.2% to about 1% by weight based on the weight of said tissue paper.

17. The process of claim 16 wherein the step of contacting said mixture of papermaking fibers and polymer-contacted filler with a cationic retention aid, further comprises the addition of a flocculant, wherein said flocculant is added after said cationic retention aid is added, thereby forming said aqueous suspension of papermaking furnish.

18. The process of claim 17 wherein in step (c) said aqueous papermaking furnish is diluted to less than 0.5% by weight after said cationic retention aid is added, but before said flocculant is added.

19. A process for incorporating a fine non-cellulosic particulate filler into a low dusting uncreped multi-layered tissue paper, said process comprising the steps of:

(a) providing an aqueous suspension of papermaking furnish comprising papermaking fibers, between about 1 percent and about 50 percent percent of the total weight of said uncreped tissue paper non-cellulosic particulate filler, and a retention aid for said particulate filler, said retention aid being selected from a group consisting of starch and anionic polyelectrolytes, wherein said particulate filler is selected from the group consisting of clay, calcium carbonate, titanium dioxide, talc, alumninum silicate, calcium silicate, alumina trihydrate, activated carbon, calcium sulfate, glass microspheres, diatomaceous earth, and mixtures thereof (b) providing at least one additional papermakig furnish;

(c) depositing said papermaking finishes onto the surface of a traveling foraminous forming fabric to form a wet embryonic papermaking web from the filler-containing aqueous papermaking furnish and the additional papermaking furnish in a manner to create a multi-layered paper web wherein at least one layer is formed from the filler-containing aqueous papermaking furnish and at least one layer is formed from said additional papermaking furnish;

(d) transferring said wet embryonic papermaking web from the forming surface to a first transfer fabric traveling at a speed from about 5% to about 75% slower than the forming fabric; and (e) transferring the wet embryonic papermaking web from the first transfer fabric via at least one further transfer to a drying fabric, whereupon said wet embryonic papermaking web is non-compressively dried so as to provide a low dusting, filled uncreped multi-layered tissue paper having a lint level less than about 12 and a density less than about 0.60 grams per cubic centimeter.

20. The process of claim 19 in which the aqueous suspension of papermaking furnish comprising papermaking fibers and non-cellulosic particulate filler is provided by the steps comprising:

(a) contacting an aqueous dispersion of said non-cellulosic particulate filler with an aqueous dispersion of said cationic starch;

(b) mixing the aqueous dispersion of starch-contacted filler with papermaking fibers forming a mixture of papermaking fibers and starch-contacted filler; and (c) contacting said mixture of papermaking fibers and starch-contacted filler with a flocculant, thereby forming said aqueous suspension of papermaking furnish.

21. The process of claim 19 in which the aqueous suspension of papermaking furnish comprising papermaking fibers and non-cellulosic particulate filler is provided by the steps comprising:

(a) contacting an aqueous dispersion of said non-cellulosic particulate filler with an aqueous dispersion of said anionic polyelectrolyte polymer;

(b) mixing the aqueous dispersion of anionic polyelectrolyte polymer-contacted filler with papermaking fibers forming a mixture of papermaking fibers and polymer-contacted filler; and (c) contacting said mixture of papermaking fibers and polymer-contacted filler with a cationic retention aid, thereby forming said aqueous suspension of papermaking furnish.

22. The process of claim 20, or 21 wherein said particulate filler is kaolin clay having an average equivalent spherical diameter between about 0.5μ and about 5μ.

23. The process of claim 22 wherein the wet embryonic papermaking web is dried by throughdrying.

* * * * *

UNITED STATES PATENT AND TRADEMARK OFFICE
CERTIFICATE OF CORRECTION

PATENT NO. : 5,759,346

DATED : June 2, 1998

INVENTOR(S) : KENNETH DOUGLAS VINSON

It is certified that error appears in the above-identified patent and that said Letters Patent is hereby corrected as shown below:

Column 20, line 30, "unereped" should read -- uncreped --.

Column 20, line 31, "unereped" should read -- uncreped --.

Column 22, line 43, delete "layered" second occurrence.

Column 36, line 1, "dying" should read -- drying --.

Column 37, line 27, after "dusting" insert -- , --.

Column 37, line 38, "alumninum" should read -- aluminum --.

Column 37, line 43, "finishes" should read -- furnishes --.

Column 38, line 11, after "uncreped" insert -- , --.

Signed and Sealed this

Twenty-sixth Day of October, 1999

*Attest:*

Q. TODD DICKINSON

*Attesting Officer*

*Acting Commissioner of Patents and Trademarks*